US008444140B2

(12) United States Patent
Mizuguchi et al.

(10) Patent No.: US 8,444,140 B2
(45) Date of Patent: May 21, 2013

(54) SHEET SIZE SETTING DEVICE, SHEET FEEDER AND IMAGE FORMING APPARATUS

(75) Inventors: Keisuke Mizuguchi, Osaka (JP); Masaaki Maruta, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 13/476,048

(22) Filed: May 21, 2012

(65) Prior Publication Data

US 2012/0299237 A1 Nov. 29, 2012

(30) Foreign Application Priority Data

May 23, 2011 (JP) ..... 2011-114769

(51) Int. Cl.
*B65H 1/00* (2006.01)

(52) U.S. Cl.
USPC ..... 271/171; 274/145

(58) Field of Classification Search
USPC ..... 271/145, 171
See application file for complete search history.

(56) References Cited

U.S. PATENT DOCUMENTS 5,273,272 A 12/1993 Nakamura et al.
5,572,310 A * 11/1996 Hoberock et al. ..... 399/370
5,655,764 A * 8/1997 Ota et al. ..... 271/171
7,533,880 B2 * 5/2009 Kawanishi et al. ..... 271/171
2004/0047663 A1 * 3/2004 Yano ..... 399/389

FOREIGN PATENT DOCUMENTS

JP 2004-210443 7/2004

OTHER PUBLICATIONS

European Search Report of Sep. 25, 2012.

* cited by examiner

*Primary Examiner* — Prasad Gokhale
(74) *Attorney, Agent, or Firm* — Gerald E. Hespos; Michael J. Porco; Matthew T. Hespos

(57) ABSTRACT

A sheet size setting device includes a first member and a second member. The first member includes a tubular holing portion having a first area and a second area in an axial direction. The second member is assembled with the first member movably in the axial direction of the tubular holding portion and includes a second indicator and a second detectable portion. A movement of the second member in the axial direction is restricted by a restricting portion. The restricting portion restricts the movement of the second member in the axial direction when the tubular holding portion is located at a first rotational position and permits the movement of the second member in the axis direction, thereby causing the second indicator to reach the first area and the second detectable portion to reach the second area, when the tubular holding portion is located at a second rotational position.

8 Claims, 11 Drawing Sheets

SHEET SIZE SETTING DEVICE, SHEET FEEDER AND IMAGE FORMING APPARATUS

This application is based on and claims the benefit of priority from Japanese Patent Application Serial No. 2011-114769 filed with the Japan Patent Office on May 23, 2011, the contents of which are hereby incorporated by reference.

BACKGROUND

The present disclosure relates to a sheet size setting device for indicating the size of sheets stored in a sheet cassette and having a sheet feeder or an image forming apparatus including the sheet cassette automatically recognize the sheet size.

An image forming apparatus such as a printer, a copier, a facsimile machine or a complex machine of these includes a sheet cassette for storing a plurality of sheets to which an image forming process is to be applied. Normally, a plurality of sheet cassettes storing different sizes of sheets are removably mounted in an apparatus main body of an image forming apparatus. Here, it is desirable to indicate which size of sheets are stored in which sheet cassette to a user and have the apparatus main body automatically recognize the sheet sizes. The present assignee has previously proposed a sheet size setting device which realizes both of these functions.

The conventionally proposed sheet size setting device is a dial-type sheet size setting device including a sheet size indicator and a detection pattern unit identifiable by a predetermined detection sensor for each size indicated on the indicator. A user turns the sheet size setting device to a proper position according to the size of sheets stored in the sheet cassette, whereby the sheet size is indicated by the indicator and identified by the detection sensor.

Sheets to be stored in the sheet cassettes include sheets of standard sizes such as "B5", "A4", "B4" and "A3" and uniquely-sized sheets (hereinafter, referred to as "Other sheets"). In the conventional sheet size setting device, a switch between sheets of standard sizes and Other sheets can be made by a simple dial changing operation. Thus, even if the sheet size is set at "Other sheets", the set sheet size may be easily changed by an erroneous operation.

Normally, a sheet cassette includes a sensor function of detecting the size of sheets accommodated therein for sheets of standardized sizes. Accordingly, even if the size is erroneously set among sheets of standardized sizes, such an error can be easily corrected. However, in the case of Other sheets, the sensor function is invalidated and the sheet size input by the user through an operation panel or the like is set. Thus, if the sheet size is erroneously set between Other sheets and sheets of standardized sizes, it takes time and effort for a correction.

An object of the present disclosure is to provide a sheet size setting device capable of maximally suppressing erroneous setting of a sheet size while easily setting the sheet size, and a sheet feeder or an image forming apparatus to which the sheet size setting device is applied.

SUMMARY

A sheet size setting device according to one aspect of the present disclosure indicates the size of sheets stored in a sheet cassette and gives identification information of the size to a predetermined sheet size detector. The sheet size setting device includes a first member and a second member. The first member includes a tubular holding portion having a first area and a second area in an axial direction and rotatable about an axis, a first indicator held in the first area of the tubular holding portion and adapted to display a first size of the sheets, and a first detectable portion formed in the second area of the tubular holding portion and to be detected for the identification of the first size by the sheet size detector. The second member is a member to be assembled with the first member movably in the axial direction of the tubular holding portion and includes an engaging portion to be engaged with the tubular holding portion, a second indicator connected to the engaging portion and adapted to indicate a second size of the sheets, and a second detectable portion to be detected for the identification of the second size by the sheet size detector. The first member further includes a restricting portion capable of restricting a movement of the second member in the axial direction. The restricting portion restricts the movement of the second member in the axial direction when the tubular holding portion is located at a first rotational position and permits the movement of the second member in the axial direction, thereby causing the second indicator to reach the first area and the second detectable portion to reach the second area, when the tubular holding portion is located at a second rotational position different from the first rotational position.

These and other objects, features and advantages of the present disclosure will become more apparent upon reading the following detailed description along with the accompanying drawings.

DETAILED DESCRIPTION

Figure 1:
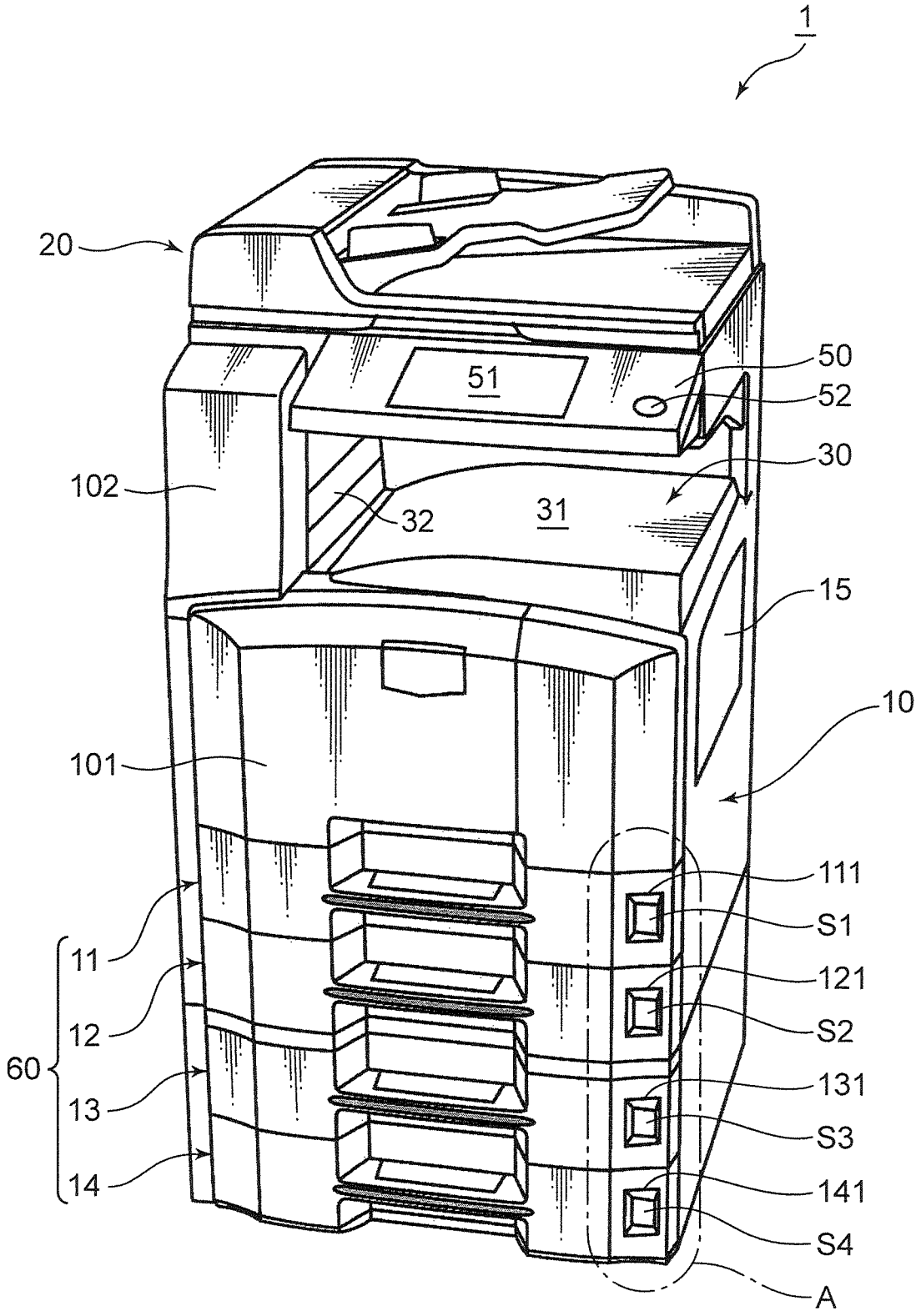
FIG. 1 is a perspective view showing the external appearance of a copier as an example of a sheet feeder (image forming apparatus) according to the present disclosure.

Hereinafter, an embodiment of the present disclosure is described in detail based on the drawings. FIG. 1 is a perspective view showing the external appearance of a copier 1 as an example of a sheet feeder (image forming apparatus) according to the present disclosure. Note that, in the present disclosure, the sheet feeder may be a printer, a facsimile machine, a complex machine of these or the like and can be applied to apparatuses in general including a sheet cassette for storing sheets.

The copier 1 is of a so-called internal discharge type and includes a box-shaped apparatus main body 10 internally provided with an image forming unit 40, a feeding unit 60 and the like, an image reading unit 20 arranged above the apparatus main body 10, and a sheet discharge unit 30 which is provided between the apparatus main body 10 and the image reading unit 20, to which sheets after image formation are to be discharged and which is at least open forward for removal of sheets.

An access cover 101 arranged in an upper part and first, second, third and fourth sheet cassettes 11, 12, 13 and 14 arranged one below another in a vertical direction, below the access cover 101, are provided on the front surface of the apparatus main body 10. The access cover 101 is openable and closable to and from a front left side about a left end side thereof serving as a rotary shaft relative to the apparatus main body 10. On the other hand, the first to fourth sheet cassettes 11 to 14 are respectively mounted in the apparatus main body 10 to be withdrawable forward.

Rectangular first, second, third and fourth window portions 111, 121, 131 and 141 are provided at front right end sides of the respective first to fourth sheet cassettes 11 to 14. First, second, third and fourth sheet size setting devices S1, S2, S3 and S4 are provided in the first to fourth sheet cassettes 11 to 14 to be seeable through these window portions. The first to fourth sheet size setting devices S1 to S4 are manually set by a user according to the sizes of sheets stored in the respective sheet cassettes.

Figure 2:
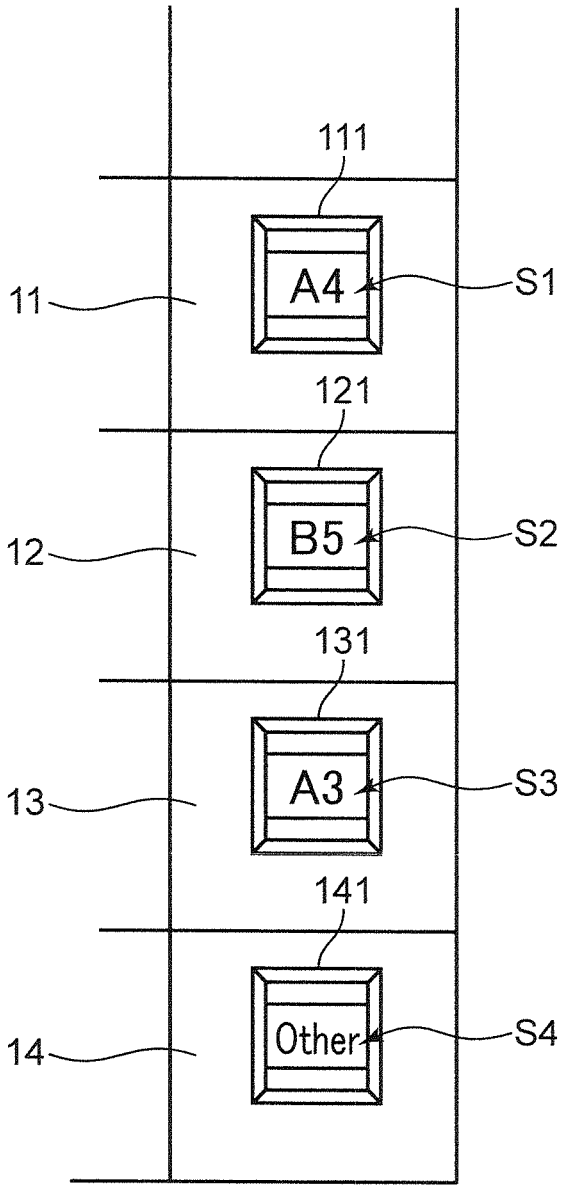
FIG. 2 is an enlarged view diagrammatically showing a part A of FIG. 1.

FIG. 2 is an enlarged view diagrammatically showing a part A of FIG. 1. Although described in detail later, each of the first to fourth sheet size setting devices S1 to S4 includes a sheet size indicator which is a rotatable dial. Here is shown an example in which the first sheet size setting device S1 displays "A4" in the first window portion 111. This indicates that sheets of A4 size are stored in the first sheet cassette 11. The user operates the first sheet size setting device S1 so that an "A4" section of the indicator faces the first window portion 111 when setting sheets of A4 size in the first sheet cassette 11. By such setting, the user can visually confirm through the first window portion 111 that the sheets of A4 size are stored in the first sheet cassette 11 and a sheet size detector (switch device 90) provided in the apparatus main body 10 can automatically recognize that the sheets of A4 size are stored in the first sheet cassette 11.

The same also applies to the second to fourth sheet cassettes 12 to 14. In FIG. 2 is shown an example in which the second sheet size setting device S2 indicates "B5" in the second window portion 121, the third sheet size setting device S3 indicates "A3" in the third window portion 131 and the fourth sheet size setting device S4 indicates "Other" in the fourth window portion 141. These indicate that sheets of B5 size are stored in the second sheet cassette 12, sheets of A3 size are stored in the third sheet cassette 13 and uniquely-sized sheets are stored in the fourth sheet cassette 14, and mean the indication of these sizes and automatic recognition of the apparatus main body 10.

Figure 3:
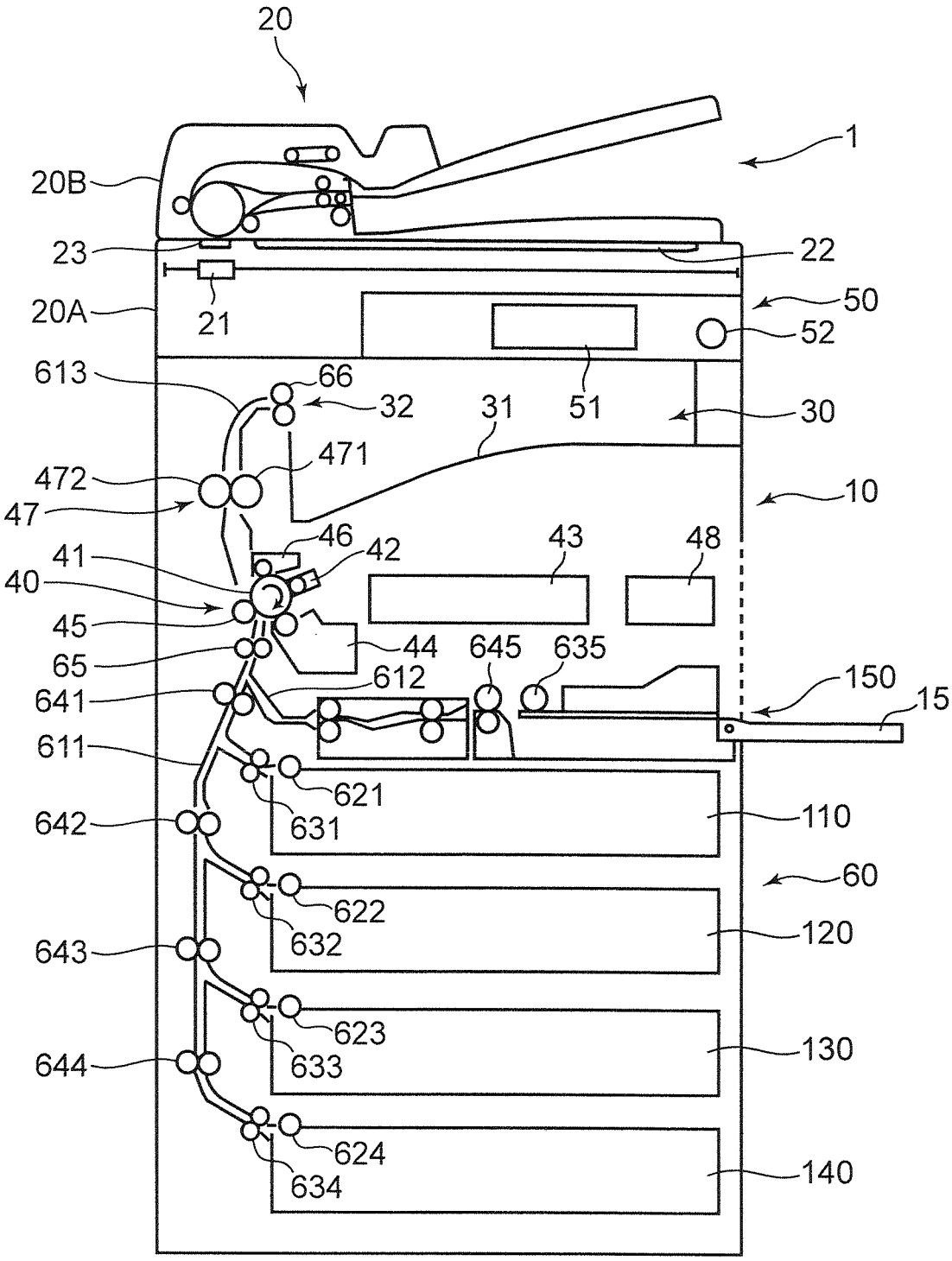
FIG. 3 is a schematic sectional view of the internal structure of the copier.

Referring back to FIG. 1, the image reading unit 20 is arranged above the apparatus main body 10 across a space for the sheet discharge unit 30. The image reading unit 20 is supported by a supporting column part 102 arranged on the left side of the upper surface of the apparatus main body 10 and a side wall arranged on the rear side of the upper surface of the apparatus main body 10. The image reading unit 20 includes an automatic document feeder unit 20B for feeding a document to be copied to a document reading position and then discharging the document, and a scanner unit 20A with an optical system for reading an image of the document (FIG. 3).

The sheet discharge unit 30 is where a sheet having an image formed thereon in the apparatus main body 10 based on a document image read by the image reading unit 20 is to be discharged and includes a discharge tray 31 and a discharge opening 32. The discharge opening 32 is an opening which is provided in the right surface (surface facing the sheet discharge unit 30) of the supporting column part 102 and through which a sheet after image formation is discharged from the apparatus main body 10. The discharge tray 31 provides a sheet receiving surface for receiving sheets discharged from this discharge opening 32.

An operation unit 50 is attached to the front surface of the image reading unit 20. The operation unit 50 receives various operation instructions and setting instructions from the user. Here, a panel including an operation display 51 composed of a liquid crystal display (LCD) or the like for displaying operation guide information and other information used to input settings and the like of various copy operations and various operation buttons, and a start key 52 used by the user to input a print execution instruction is illustrated as the operation unit 50. In addition to these, the operation unit 50 includes a numerical keypad which receives the input of a number of sets to be printed, and the like.

Next, the internal configuration of the copier 1 is described. FIG. 3 is a sectional view schematically showing the internal configuration of the copier 1. As described above, the copier 1 includes the apparatus main body 10 with the supporting column part 102 on the upper surface thereof, the image reading unit 20, the sheet discharge unit 30 and the operation unit 50. The feeding unit 60, the image forming unit 40 and a fixing unit 47 are provided in the apparatus main body 10.

The image reading unit 20 includes the scanner unit 20A and the automatic document feeder unit 20B arranged atop the scanner unit 20A. The scanner unit 20A is internally provided with a moving frame 21 including an exposure lamp for irradiating light to a document. Although not shown, a CCD (Charge Coupled Device) sensor for generating image data by photoelectrically converting reflected light from a document, an optical system for introducing the reflected light to this CCD sensor and the like are built in the scanner unit 20A. Further, a first platen glass 22 for reading a placed document and a second platen glass 23 for reading an automatically fed document are provided on the upper surface of the scanner unit 20A.

The automatic document feeder unit 20B includes a sheet tray for storing documents to be read and a discharge unit for receiving read documents. The automatic document feeder unit 20B feeds a document from the feed tray to the document reading position of the second platen glass 23 and discharges the read document to the discharge unit by the operation of a document feeding mechanism provided therein.

The feeding unit 60 of the apparatus main body 10 feeds a sheet to the image forming unit 40. The feeding unit 60 includes first to fourth sheet storage sections 110 to 140 which respectively correspond to the first to fourth sheet cassettes 11 to 14 described above and in which sheets of respective sizes are stored, and a manual feeding unit 150 composed of a manual feed tray 15 openably and closably attached to a right side part of the apparatus main body 10. Although not shown, cursors for positioning a sheet stack, a lifter for elastically lifting the sheet stack to bring the uppermost sheet into contact with the corresponding one of pickup rollers 621 to 624 to be described later and the like are provided in each of the first to fourth sheet storage sections 110 to 140.

A sheet conveyance path for conveying a sheet is provide on a route from such a feeding unit 60 to the discharge opening 32 through the image forming unit 40 and the fixing unit 47. The sheet conveyance path includes a first sheet conveyance path 611 from the first to fourth sheet storage sections 110 to 140 to the image forming unit 40, a second sheet conveyance path 612 from the manual feeding unit 150 to the image forming unit 40 and a third sheet conveyance path 613 from the image forming unit 40 to the discharge opening 32.

The pickup rollers 621, 622, 623 and 624 for picking up stored sheets one by one and feed roller pairs 631, 632, 633 and 634 arranged downstream of the pickup rollers are respectively provided above sheet pickup sides of the first to fourth sheet storage sections 110 to 140. The feed roller pairs 631, 632, 633 and 634 are for feeding picked up sheets to the first sheet conveyance path 611.

Conveyor roller pairs 641, 642, 643 and 644 for conveying sheets toward the image forming unit 40 are provided in the first sheet conveyance path 611. Further, a feed roller 635 for conveying a manually fed sheet to the image forming unit 40 and a conveyor roller pair 645 for conveying the manually fed sheet to the image forming unit 40 are provided in the second sheet conveyance path 612. Further, a registration roller pair 65 for causing a sheet to wait before the image forming unit 40 is provided at an end position of the first sheet conveyance path 611. A discharge roller pair 66 for conveying (discharging) a sheet toward the sheet discharge unit 30 is arranged at an end position of the third sheet conveyance path 613. The discharge opening 32 is provided to extend along this discharge roller pair 66.

The image forming unit 40 performs a process of transferring a toner image to a sheet conveyed from the feeding unit 60 based on image data of a document obtained by the image reading unit 20. The image forming unit 40 includes a photoconductive drum 41 provided rotatably about its shaft, and a charger 42, an exposure device 43, a developing device 44, a transfer roller 45 and a cleaner 46 arranged along the circumferential surface of the photoconductive drum 41.

The photoconductive drum 41 is for forming an electrostatic latent image and a toner image in conformity with this electrostatic latent image on the circumferential surface thereof. An amorphous silicon photoconductive drum having an amorphous silicon layer laminated on the circumferential surface is suitably used as the photoconductive drum 41. The charger 42 uniformly charges the circumferential surface of the photoconductive drum 41. The exposure device 43 irradiates laser light modulated based on the image data to the circumferential surface of the rotating photoconductive drum 41. Electric charges are removed in a part of the circumferential surface of the photoconductive drum 41 irradiated with the laser light, whereby an electrostatic latent image corresponding to a laser light irradiation pattern is formed on the circumferential surface of the photoconductive drum 41.

The developing device 44 supplies toner to the circumferential surface of the photoconductive drum 41 via a built-in developing roller. When the toner is supplied to the photoconductive drum 41, the toner adheres to the part where the electrostatic latent image is formed, whereby a toner image is formed on the circumferential surface of the photoconductive drum 41. An unillustrated toner container is detachably attached to the developing device 44. When the toner in the developing device 44 is used up, toner is supplied from this toner container.

The transfer roller 45 forms a nip portion together with the photoconductive drum 41 and transfers a toner image formed on the circumferential surface of the photoconductive drum 41 to a sheet fed to the nip portion. If the toner image on the circumferential surface of the photoconductive drum 41 is, for example, positively charged, the transfer roller 45 applies negative electric charges having a polarity opposite to that of the electric charges of the toner image to the sheet. The cleaner 46 cleans by removing the toner remaining on the circumferential surface of the photoconductive drum 41 after a transfer process.

The fixing unit 47 applies a fixing process by heating a sheet having a toner image transferred thereto by the image forming unit 40. The fixing unit 47 includes a heat roller 471 with a built-in electric heating element and a pressure roller 472 whose circumferential surface is arranged to face that of the heat roller 471. The sheet after the transfer process passes through a nip portion between the heat roller 471 and the pressure roller 472 that are driven and rotated, whereby a fixing process is applied with heat received from the heat roller 471. Thereafter, the sheet is discharged to the sheet discharge unit 30 via the third sheet conveyance path 613 and the discharge roller pair 66.

Figure 4:
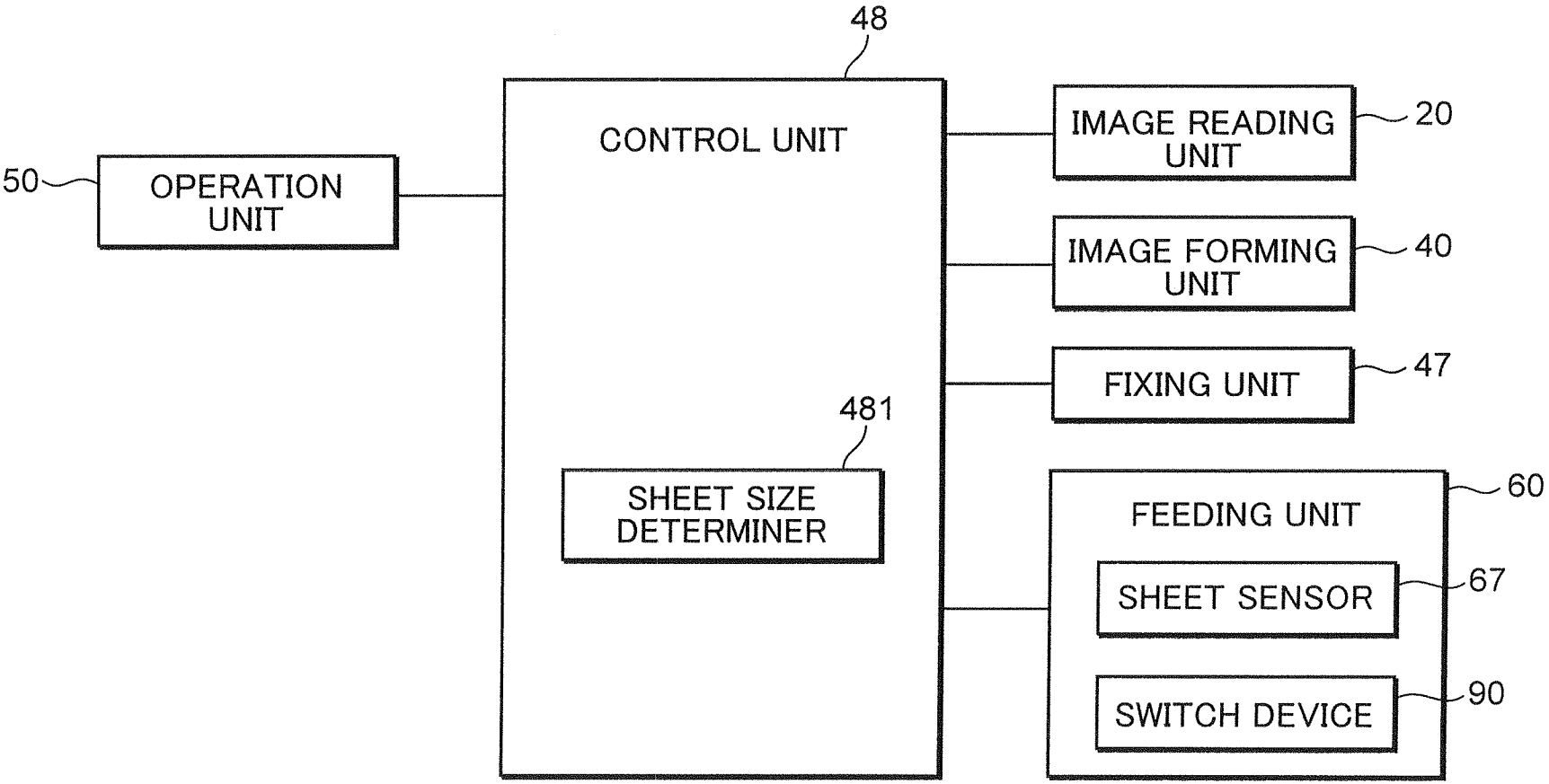
FIG. 4 is a block diagram showing the electrical configuration of the copier.

FIG. 4 is a block diagram showing the electrical configuration of the copier 1. The copier 1 includes a control unit 48 for controlling the operations of the respective parts of the copier 1. The control unit 48 is composed of a microcomputer with built-in storages such as a ROM storing, for example, a control program and a flash memory for temporarily storing data.

The control unit 48 drives the image reading unit 20, the image forming unit 40, the fixing unit 47, the feeding unit 60 and the like to apply a predetermined image forming operation to a sheet in accordance with an operation instruction given to the operation unit 50. For example, when a document sheet of A4 size is set in the image reading unit 20 and an operation instruction to copy at the same magnification is given to the operation unit 50 by the user, the control unit 48 causes a sheet to be picked up from the sheet cassette (first sheet cassette 11 in the example of FIG. 2) storing sheets of A4 size out of the feeding unit 60 and causes the image forming unit 40 and the fixing unit 47 to apply the image forming process and the fixing process to this A4 sheet.

In this embodiment, the feeding unit 60 includes sheet sensors 67 and switch devices 90 (sheet size detectors) each with a plurality of contact switches, and the control unit 48 functionally includes a sheet size determiner 481. The sheet sensor 67 is provided for each of the respective first to fourth sheet cassettes 11 to 14 (first to fourth sheet storage sections 110 to 140) and outputs a first detection signal corresponding to the size of sheets stored in the sheet cassette. An optical sensor including a light reflector or a light blocker which moves in tandem with the cursors in the sheet cassette as a detection element may be, for example, used as the sheet sensor 67. Sheet sizes identifiable by the sheet sensors 67 are, for example, "A5", "A4", "A3", "B5", "B4" and "LT (letter size)".

The switch devices 90 are provided in correspondence with the first to fourth sheet size setting devices S1 to S4 respectively arranged in the first to fourth sheet cassettes 11 to 14 and detect detection patterns for sheet size identification formed by the respective sheet size setting devices S1 to S4. That is, the switch device 90 detects identification information for the sheet size set by the user and outputs a second detection signal corresponding to the detected size of sheets.

The sheet size determiner 481 determines the size of sheets stored in each of the first to fourth sheet cassettes 11 to 14 and provides sheet size information necessary, such as for sheet cassette selection, when the control unit 48 performs the image forming process. The first detection signals output by the sheet sensors 67 and the second detection signals output by the switch devices 90 are input to this sheet size determiner 481.

Sheet sizes settable by the first to fourth sheet size setting devices S1 to S4 are, for example, standard sizes such as "A5", "A4", "A3", "B5", "B4" and "LT" and unique size "Other". The sheet size determiner 481 compares the size obtained from the first detection signal and the size obtained from the second detection signal if the second detection signal indicates sheets of a standard size. If both sizes coincide, the obtained size is provided as sheet size information. On the other hand, unless both sizes coincide, the sheet size determiner 481 outputs an error signal and error information is displayed on the panel (operation display 51) of the operation unit 50.

On the contrary, if the second detection signal indicates "Other", the sheet size determiner 481 invalidates the first detection signal given from the sheet sensor 67 and causes an input screen for sheet size to be displayed on the panel of the operation unit 50, thereby urging custom input of sheet size information to the user. This custom input is the selective input of a standard relatively little used in Japan such as "LDR", "LGL", "Folio" and "EXEC" or the input of numerical values of sheet width and sheet length uniquely set by the user. If the sheet size information is input to the operation unit 50, the sheet size determiner 481 provides the sheet size information to the control unit 48.

Figure 5:
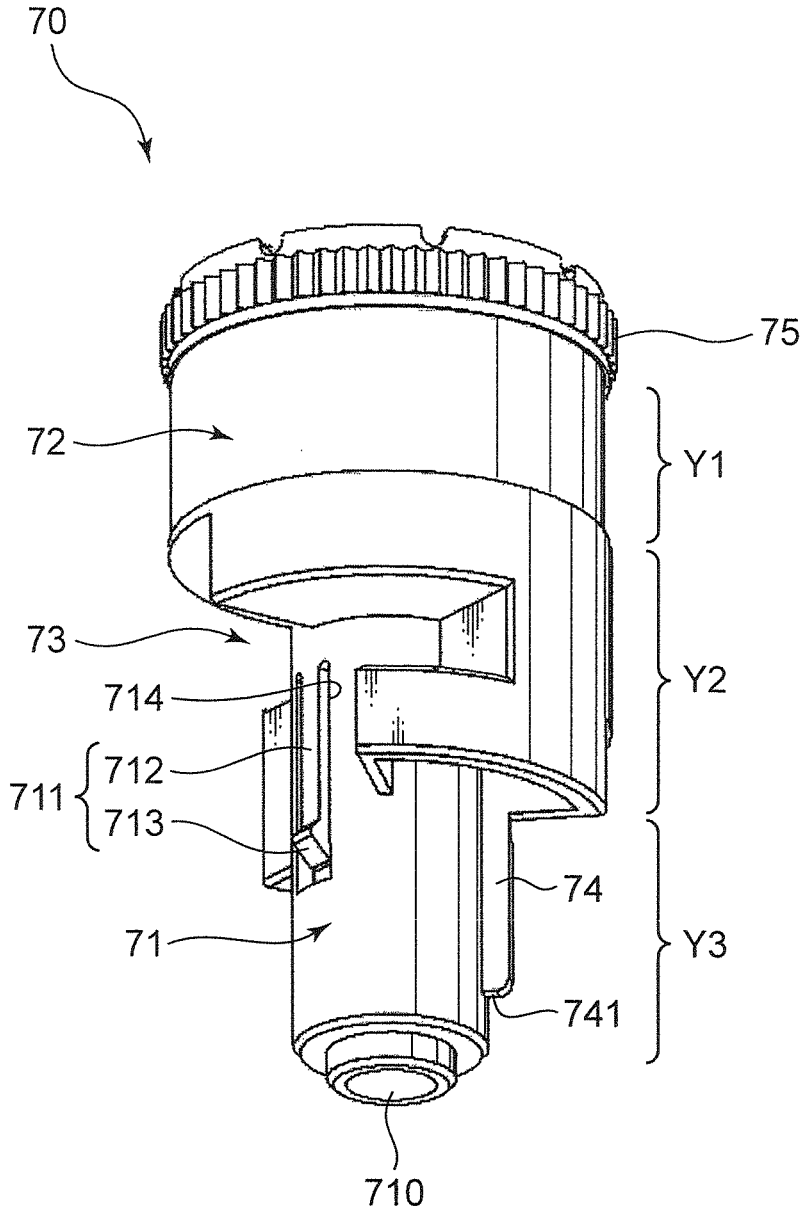
FIG. 5 is a perspective view showing a first member of a sheet size setting device.
Figure 6:
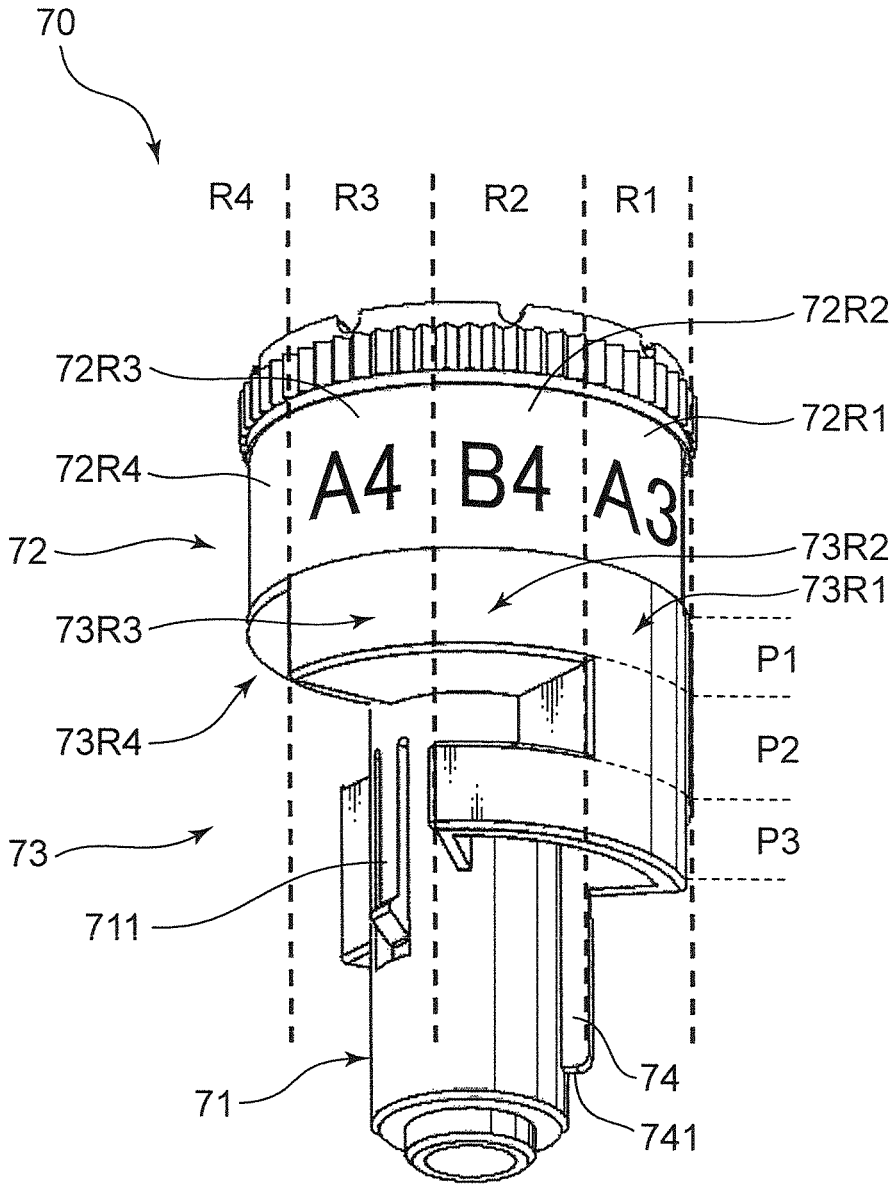
FIG. 6 is a perspective view showing the function of the first member.
Figure 7:
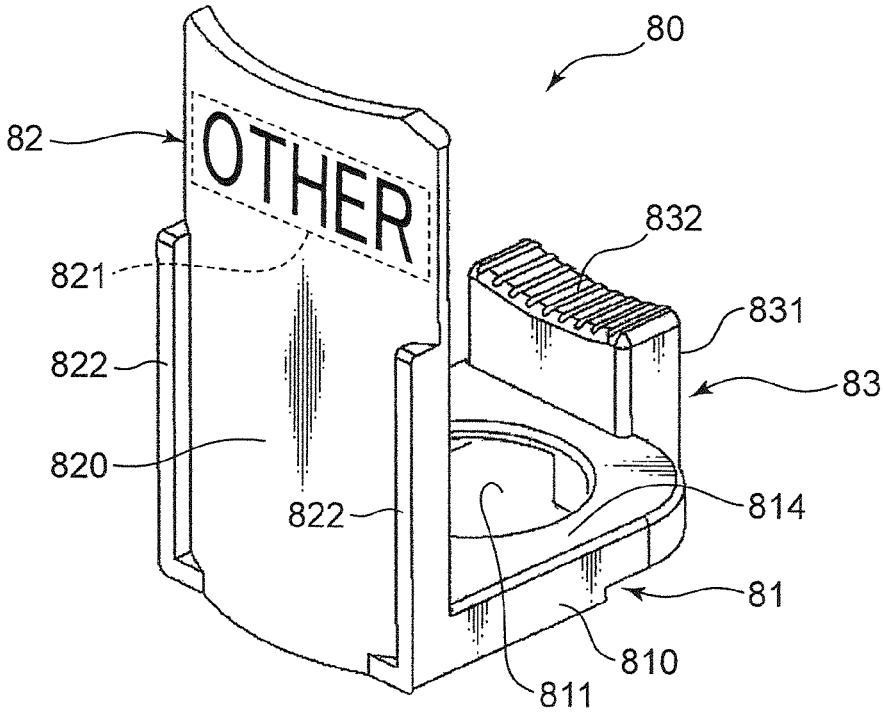
FIG. 7 is a perspective view showing a second member of the sheet size setting device.
Figure 8:
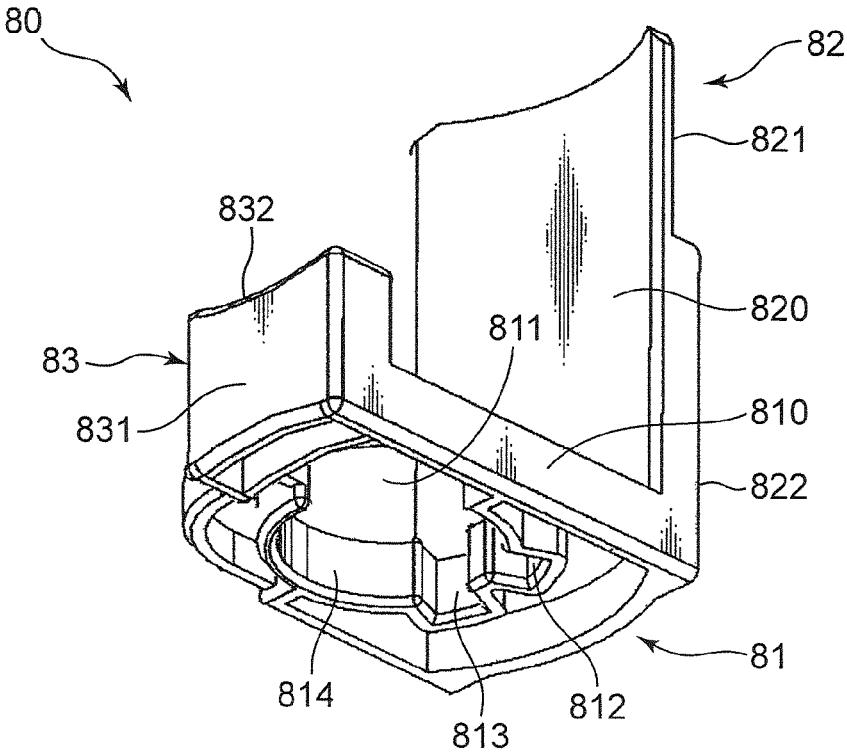
FIG. 8 is a perspective view showing the second member when viewed at a different angle.
Figure 9:
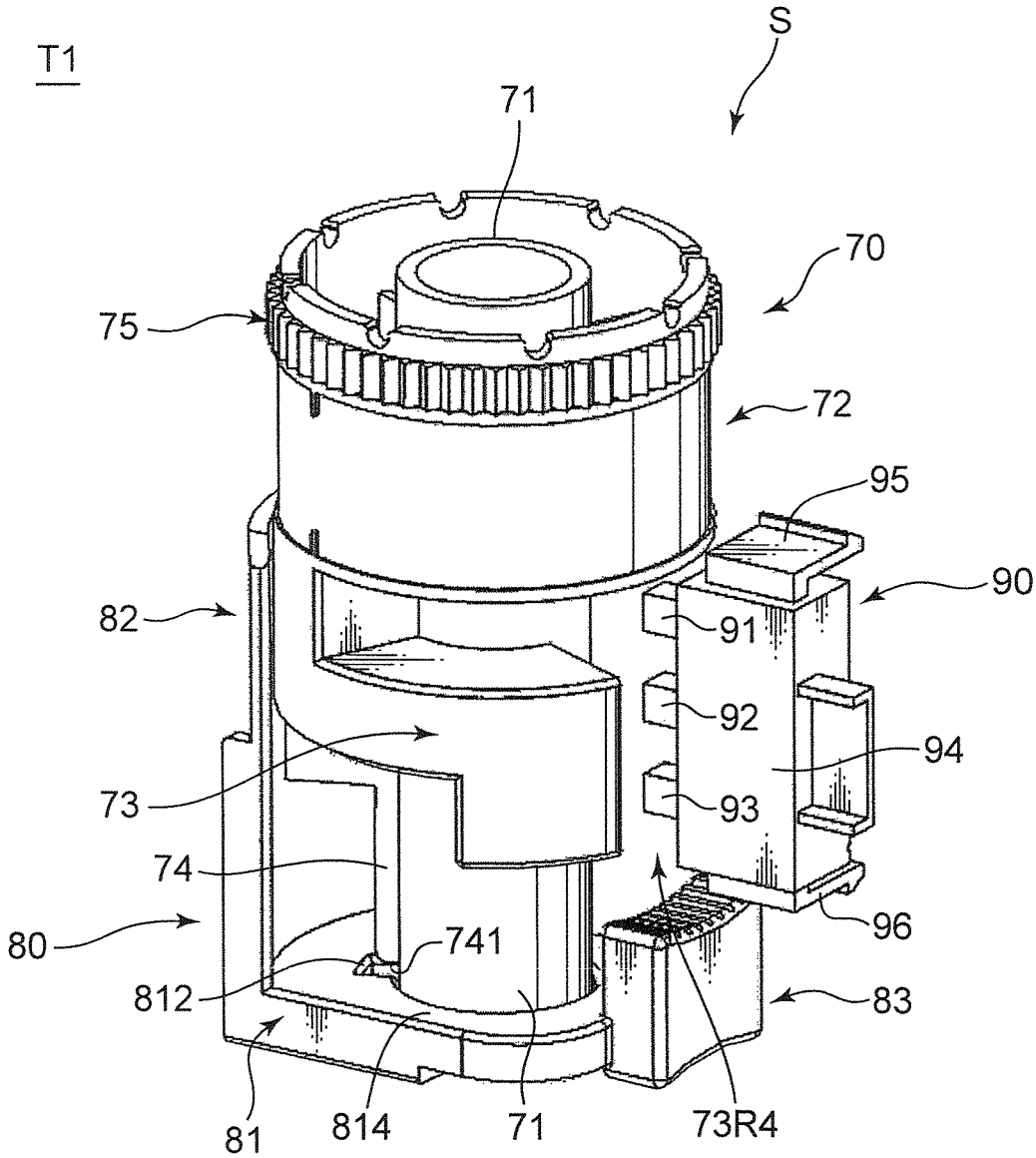
FIG. 9 is a perspective view of the sheet size setting device showing a state where the second member is in a retracted posture.
Figure 10:
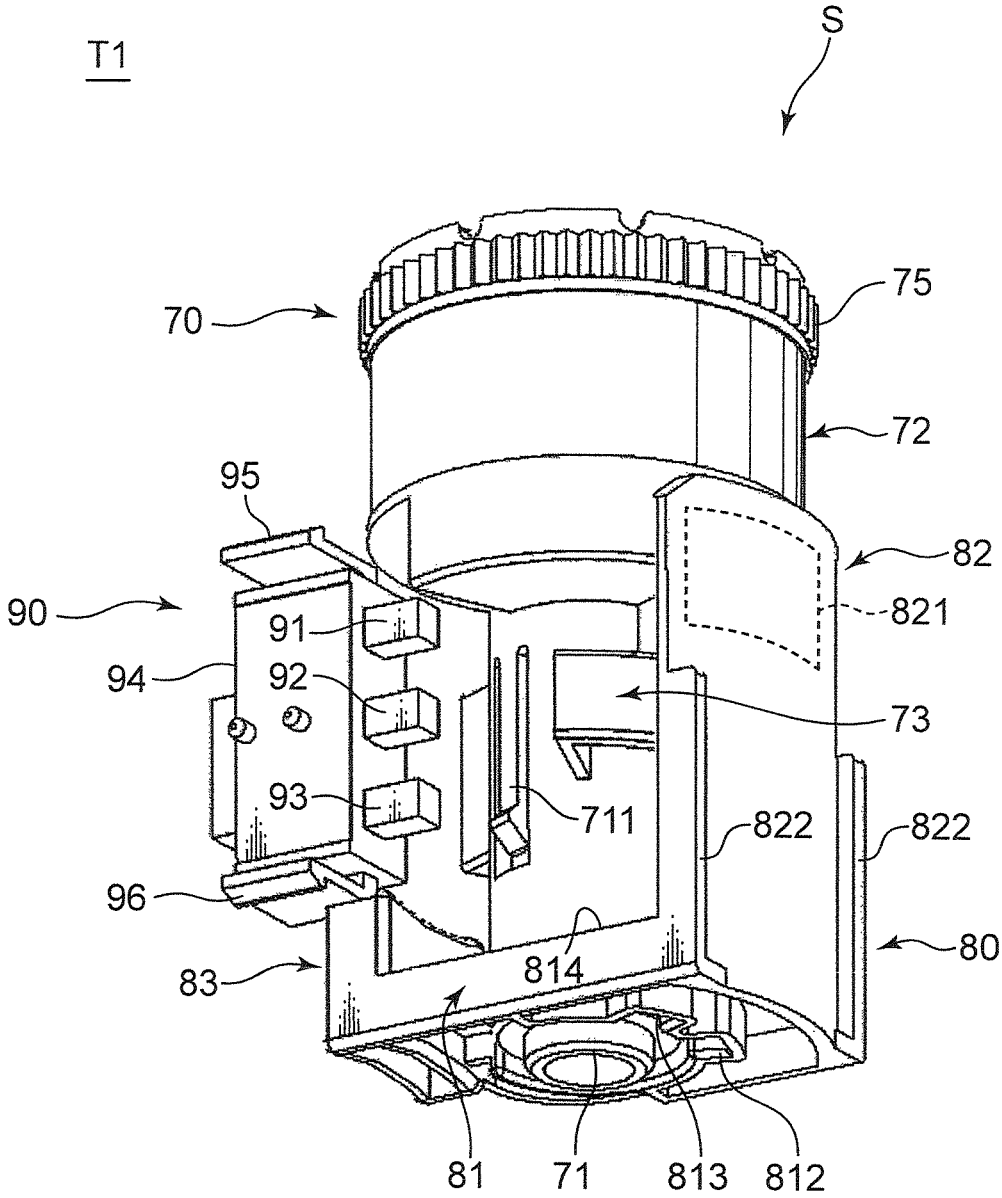
FIG. 10 is a perspective view of the sheet size setting device of FIG. 9 when viewed at a different angle.
Figure 11:
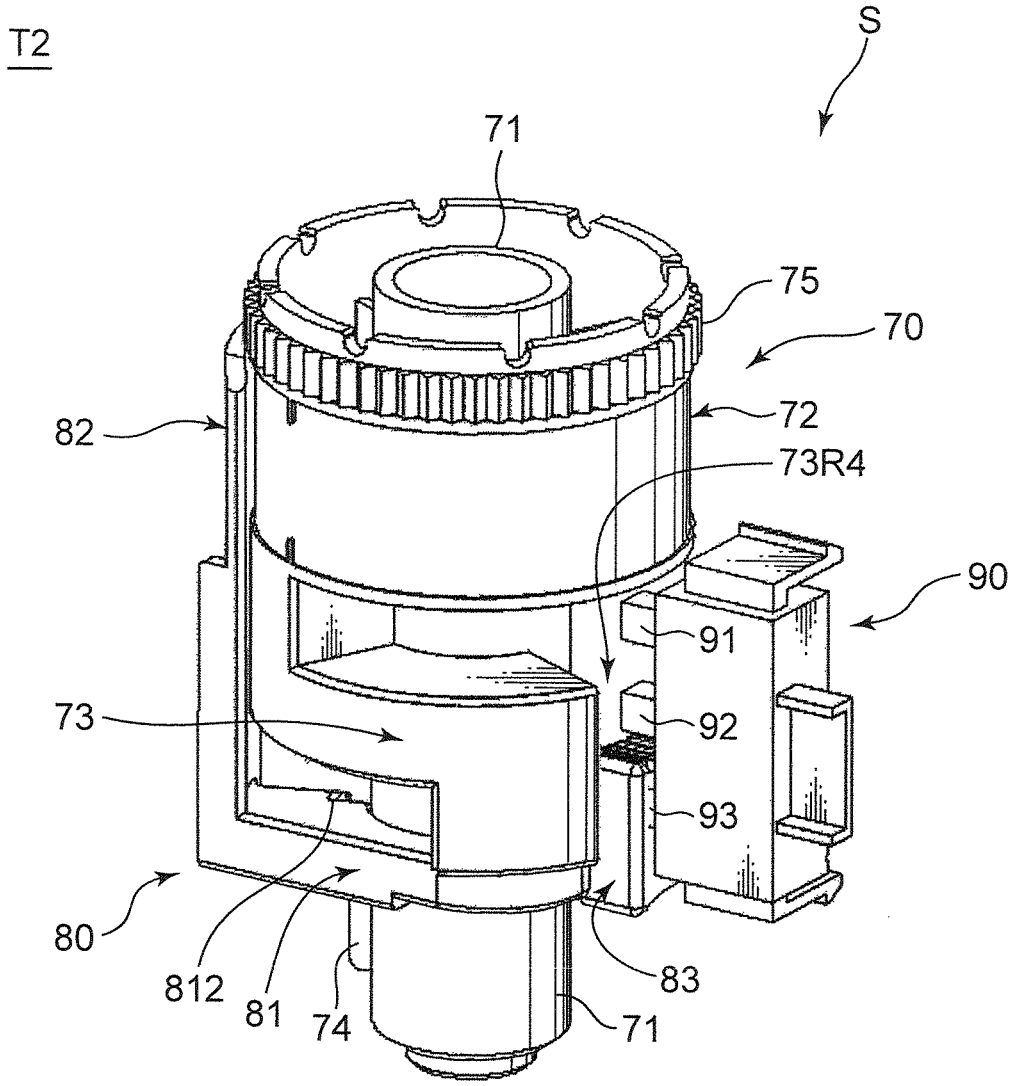
FIG. 11 is a perspective view of the sheet size setting device showing a state where the second member is in an indicating posture.
Figure 12:
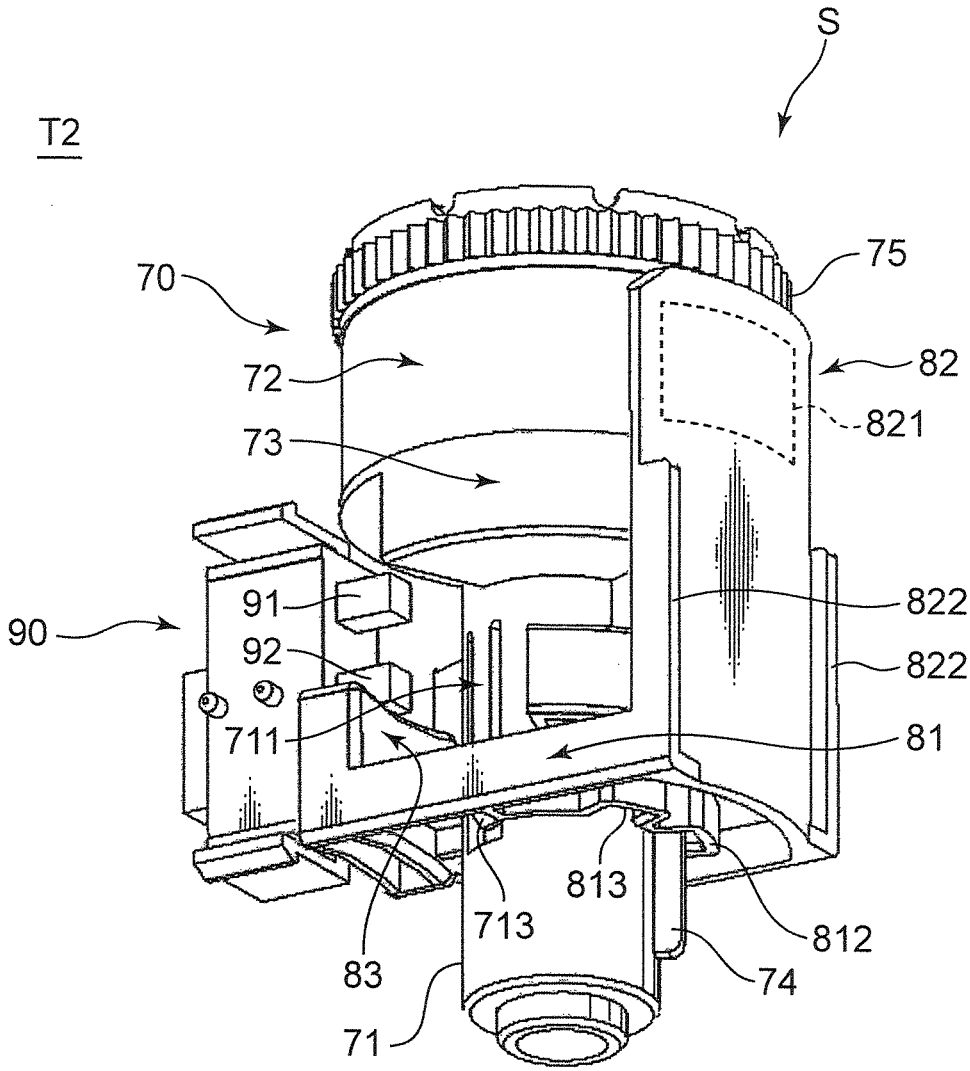
FIG. 12 is a perspective view of the sheet size setting device of FIG. 11 when viewed at a different angle.

Next, a specific configuration of the sheet size setting device according to this embodiment is described in detail with reference to FIGS. 5 to 12. All of the above first to forth sheet size setting devices S1 to S4 have the same configuration and are described as a sheet size setting device S below. FIG. 5 is a perspective view showing a first member 70 of the sheet size setting device S. FIG. 6 is a perspective view showing the function of the first member 70. FIG. 7 is a perspective view showing a second member 80 of the sheet size setting device S. FIG. 8 is a perspective view showing the second member 80 when viewed at a different angle. FIG. 9 is a perspective view of the sheet size setting device S showing a state where the second member 80 is in a retracted posture T1. FIG. 10 is a perspective view of the sheet size setting device S of FIG. 9 when viewed at a different angle. FIG. 11 is a perspective view of the sheet size setting device S showing a state where the second member 80 is in an indicating posture T2. FIG. 12 is a perspective view of the sheet size setting device S of FIG. 11 when viewed at a different angle.

As described above, the sheet size setting device S is a device for displaying the size of sheets stored in each of the first to fourth sheet cassettes 11 to 14 and giving the sheet size identification information to the switch device 90. The sheet size setting device S is composed of the first member 70 and the second member 80 assembled movably relative to the first member 70.

The first member 70 includes a tubular holding portion 71, a first indicator 72, a first detectable portion 73, a rib 74 and a dial operating portion 75. The tubular holding portion 71 is a cylindrical body extending in a vertical direction and a shaft hole 710 is formed inside. A rotational supporting shaft (not shown) standing in the sheet cassette is inserted into the shaft hole 710, whereby the first member 70 is rotatable about the center axis of the tubular holding portion 71. Note that an unillustrated ratchet mechanism is attached to the first member 70 so that a click feeling can be obtained at every constant rotation angle.

As shown in FIG. 5, the dial operating portion 75 is arranged at the upper end of the tubular holding portion 71. A first area Y1 where the first indicator 72 is arranged is set below the dial operating portion 75, and a second area Y2 where the first detectable portion 73 is arranged is set below the first area Y1. The circumferential surface of the tubular holding portion 71 is exposed in a third area Y3 below the second area Y2, and the rib 73 extends in the vertical direction (axial direction) on the circumferential surface in the third area Y3.

An elastic supporting portion 711 for supporting the second member 80 set in the indicating posture T2 is provided from the second area Y2 to the third area Y3 on the circumferential surface of the tubular holding portion 71. The elastic supporting portion 711 is composed of a supporting piece 712 extending in the vertical direction and a supporting claw 713 projecting radially outwardly from the lower end of the supporting piece 712. The supporting piece 712 is a long and narrow and springy member formed by a slit 714 perforated in the vertical direction in the circumferential surface of the tubular holding portion 71.

With reference to FIGS. 5 and 6, the first indicator 72 is held in the first area Y1 of the tubular holding portion 71 and has a cylindrical indicating outer circumferential surface for indicating standard sheet sizes (first size). Size indicating symbols of versatile standard sizes (these differ depending on the country and area of planned use) such as "A5", "A4", "A3", "B5", "B4" and "LT" are printed on the indicating outer circumferential surface of the first indicator 72.

Specifically, a plurality of individual areas R1, R2, R3, R4, etc. having an equal width are set in a circumferential direction of the tubular holding portion 71. For example, the individual areas are eight strip-like areas obtained by dividing the circumferential surface of the tubular holding portion 71 at every 45°. The size indicating symbols are respectively printed on sections of the indicating outer circumferential surface of the first indicator 72 corresponding to these individual areas R1, R2, R3, R4, etc. In FIG. 6 is shown an example in which the size indicating symbol of "A3" is printed on a first indicating surface 72R1 corresponding to the individual area R1. Further, the size indicating symbol of "B4" is printed on a second indicating surface 72R2 corresponding to the individual area R2, and that of "A4" is printed on a third indicating surface 72R3 of the individual area R3. Note that no size indicating symbol is printed on a fourth indicating surface 72R4 corresponding to the individual area R4. This is because indication by a second indicator 82 of the second member 80 is planned in the area of the fourth indicating surface 72R4.

The first detectable portion 73 is a part which is formed in the second area Y2 of the tubular holding portion 71 and to be detected for standard size identification by the switch device 90. The first detectable portion 73 forms detection patterns having a convexo-concave shape for the identification of the sheet size by the switch device 90 including a plurality of contact switches 91, 92 and 93 to be described later. First, second, third and fourth pattern forming areas 73R1, 73R2, 73R3 and 73R4 are set on the first detectable portion 73 in correspondence with the sections of the individual areas R1, R2, R3, R4, etc. In each of the pattern forming areas 73R1, 73R2, 73R3 and 73R4, a convexo-concave shape set in advance for each of the sheet sizes indicated on the indicating surfaces 72R1, 72R2, 72R3, 72R4 right above is formed.

To form these convexo-concave shapes, the second area Y2 shown in FIG. 5 is divided into three sections in the vertical direction to set three convexo-concave forming units P1, P2 and P3 as shown in FIG. 6. Convex surfaces and concave surfaces are formed in these convexo-concave forming units P1, P2 and P3, and a detection pattern is formed by a combination of these. For example, any of the convexo-concave forming units P1, P2 and P3 is a convex surface in the first pattern forming area 73R1 corresponding to the individual area R1. If the convex surface is expressed by ○ (ON) and the concave surface by × (OFF), this first pattern forming area 73R1 indicates a detection pattern of "○○○". The above sheet size detector 481 receives the second detection signal to the effect that sheets of "A3" size are stored in the sheet cassette when this detection pattern is detected by the switch device 90.

In the second pattern forming area 73R2 corresponding to the individual area R2, the convexo-concave forming units P1, P3 are convex surfaces and the convexo-concave forming unit P2 is a concave surface. Further, in the third pattern forming area 73R3 corresponding to the individual area R3, only the convexo-concave forming unit P1 is a convex surface and the convexo-concave forming units P2 and P3 are concave surfaces. That is, the second pattern forming area 73R2 indicates a detection pattern "○×○" and the third pattern forming area 73R3 indicates a detection pattern "○××", and these detection patterns respectively serve as identification information indicating sheets of "B4" size and sheets of "A4" size. The above first, second and third pattern forming areas 73R1, 73R2 and 73R3 are convexo-concave forming portions which form detection patterns for sheet size identification. Contrary to this, a convex surface (detection pattern) is intentionally not formed in the fourth pattern forming area 73R4 (receiving portion) corresponding to the individual area R4. This is because the fourth pattern forming area 73R4 permits the entrance of a second detectable portion 83 of the second member 80 and the formation of a detection pattern for "Other" sheets is planned.

Here, there are eight convexo-concave detection patterns which can be formed by the eight individual areas R1 to R8 and the three convexo-concave forming units P1 to P3 in the first detectable portion 73 as shown in Table 1. As in the above example, ○ denotes the convex surface and × denotes the concave surface in Table 1.

TABLE 1

| Individual Area | P1 | P2 | P3 |
|---|---|---|---|
| R1 | ○ | ○ | ○ |
| R2 | ○ | x | ○ |
| R3 | ○ | x | x |
| R4 | x | x | ○ |
| R5 | x | x | x |
| R6 | x | ○ | ○ |
| R7 | x | ○ | x |
| R8 | ○ | ○ | x |

In this embodiment, a detection pattern (only the convexo-concave forming unit P3 is a convex surface) of the individual area R4 is not formed by the first detectable portion 73 of the first member 70, but by the convex surface of the second detectable portion 83 of the second member 80 to be described next. On the other hand, the individual area R5 is an area planned to have a detection pattern formed by the convexo-concave forming units P1 to P3 that are all concave surfaces. Accordingly, any of the convexo-concave forming units P1 to P3 is a concave surface in both the fourth pattern forming area 73R4 corresponding to the individual area R4 and the fifth pattern forming area corresponding to the individual area R5 (not shown in FIG. 6).

The rib 74 is an elongated projection extending in the vertical direction on the tubular holding portion 71. A lower end edge 741 (restricting portion) of the rib 74 is located somewhat above the lower end of the tubular holding portion 71 and the upper end thereof is connected to the convexo-concave forming portion of the first detectable portion 73. The lower end edge 741 restricts a movement of the second member 80 in the axial direction when the tubular holding portion 71 is at a first rotational position. On the other hand, the rib 74 functions to guide a movement of the second member 80 in the axial direction when the tubular holding portion 71 is at a predetermined second rotational position different from the first rotational position.

The dial operating portion 75 is a part that the user operates in rotating the first member 70 about the axis of the tubular holding portion 71 to set the sheet size. The dial operating portion 75 is formed such that small projections are connected in an annular manner to facilitate the operation of the user or for anti-slip purpose.

The second member 80 is a member to be assembled with the first member 70 movably in the axial direction of the tubular holding portion 71 and includes an engaging portion 81, the second indicator 82 and the second detectable portion 83 as shown in FIGS. 7 and 8.

The engaging portion 81 is a part to be engaged with the tubular holding portion 71 of the first member 70. In this embodiment, the engaging portion 81 includes a frame member 810 in the form of a rectangular flat plate when viewed from above, and a through hole 811 perforated in a central part of the frame member 810. The tubular holding portion 71 is inserted into this through hole 811 (see FIGS. 9 to 12), whereby the second member 80 is movable in the axial direction of the tubular holding portion 71 while being kept engaged with the first member 70.

The through hole 811 is a substantially circular hole, but the inner peripheral wall of the frame member 810 forming this through hole 811 includes two partial large-diameter portions 812, 813 (second part) and a small-diameter portion 814 (first part) having a smaller diameter than the large-diameter portions 812, 813 (FIG. 8). The small-diameter portion 814 has an inner diameter slightly larger than an outer diameter of the tubular holding portion 71. Accordingly, the small-diameter portion 814 interferes with the lower end edge 741 of the rib 74 when facing the position of the rib 74 in a state where the engaging portion 81 is fitted to the third area Y3 of the tubular holding portion (FIG. 5). The large-diameter portions 812, 813 have an inner diameter slightly larger than the outer diameter of the tubular holding portion 71 including the projecting height of the rib 74. Thus, there is no interference if the large-diameter portions 812, 813 are facing the position of the rib 74.

That is, a movement of the second member 80 (engaging portion 81) along the axial direction is restricted and this restriction is released depending on the rotational position of the first member 70 (tubular holding portion 71). When the tubular holding portion 71 is located at a rotational position (first rotational position) where the rib 74 of the tubular holding portion 71 and the small-diameter portion 814 face each other, the small-diameter portion 814 interferes with the lower end edge 741 of the rib 74, wherefore the second member 80 cannot move upward in the axial direction from the retracted posture T1 shown in FIGS. 9 and 10. Contrary to this, when the tubular holding portion 71 is located at a rotational position (second rotational position) where the rib 714 and either one of the large-diameter portions 812, 813 face each other, the second member 80 can move upward in the axial direction from the retracted posture T1 to assume the indicating posture T2 shown in FIGS. 11 and 12. During this upward movement along the axial direction, the large-diameter portion 812 or 813 is guided by the rib 74. As just described, according to this embodiment, a function of restricting the movement of the second member 80 in the axial direction and guiding the movement of the second member in the axial direction can be achieved by a simple configuration of providing the rib 74 on the tubular holding portion 71.

The second indicator 82 is a part indicating a unique sheet size (second size). In this embodiment, the second indicator 82 is used to indicate "Other". The second indicator 82 includes a vertical plate 820 having a curved surface substantially in conformity with the cylindrical curved surface of the first indicator 72. The lower end of this vertical plate 820 is connected to one side of the engaging portion 81. An indication area 821 is provided on an upper part of a surface (surface shown in FIG. 7) of the vertical plate 820, and a size indicating symbol of "OTHER" is printed on the indication area 821. Note that spacer ribs 822 are provided on both side edges of the vertical plate 820.

The second detectable portion 83 is a part to be detected for sheet size identification by the switch device 90 in a state where the second member 80 is in the indicating state T2. The second detectable portion 83 includes an interference piece 831 standing on the other side of the engaging portion 81. The interference piece 831 is a member which is insertable into the first detectable portion 73 of the first member 70 described above and fills up one of the convexo-concave forming units as a convex surface. In this embodiment, the interference piece 831 (second detectable portion 83) is a member which can be located at the convexo-concave forming unit P3 of the fourth pattern forming area 73R4 and forms a convex surface when being located at the convexo-concave forming unit P3 (indicating posture T2). That is, the interference piece 831 forms a detection pattern for "Other" size in the fourth pattern forming area 73R4. The top surface [k1] of the interference piece 831 serves as an operation surface 832 which is operated by the finger when the user moves the second member 80 in downward direction. The bottom surface of the interference piece 831 is operable when the user moves the second member 80 in upward.

With reference to FIGS. 9 and 10, the switch device 90 includes three contact switches 91, 92 and 93 that project and retract due to interference with detection targets (convex surfaces of the detection pattern formed by the first and second detectable portions 73, 83 in this embodiment). The contact switches 91, 92 and 93 are held in a case 94 and retract into the case 94 when coming into contact with the detection targets to output ON signals. On the other hand, the contact switches 91, 92 and 93 do not output the ON signals and are kept in an OFF state while being not in contact with the detection targets.

The switch device 90 is mounted in the apparatus main body 10 near the disposed position of the sheet size setting device S of the sheet cassette. Locking pieces 95, 96 used to assemble the switch device 90 into the apparatus main body 10 are attached to the upper and lower sides of the case 94.

Next, with reference to FIGS. 9 to 12, a posture change of the second member 80 is described. FIGS. 9 and 10 show a state where the second member 80 is in the retracted posture T1 and the first member 70 (tubular holding portion 71) is set at a rotational position (second rotational position) where the rib 74 of the tubular holding portion 71 and the large-diameter portion 812 of the engaging portion 81 face each other. In the retracted posture T1, the second member 80 is engaged with the first member fitted in the through hole 811 of the engaging portion 81 at the bottommost position of the tubular holding portion 71 extending in the vertical direction.

In the retracted posture T1, the second indicator 82 is retracted downwardly of the first indicator 72. The indication area 821 of the second indicator 82 is located in the second area Y2 shown in FIG. 5. Accordingly, indication of the first indicator 72 is shown and that of the second indicator 82 is not shown in the first to fourth window portions 111 to 141 (FIG. 2) of the first to fourth sheet cassettes 11 to 14. Further, the second detectable portion 83 is retracted into the third area Y3 below the first detectable portion 73. Thus, this is a state where the second detectable portion 83 (interference piece 831) does not form any detection pattern for the switch device 90.

When the tubular holding portion 71 is set at a rotational position (first rotational position) where the rib 74 of the tubular holding portion 71 and the small-diameter portion 814 of the engaging portion 81 face each other unlike the state of FIGS. 9 and 10, an upper edge part of the small-diameter portion 814 and the lower end edge 741 of the rib 74 interfere, wherefore an upward movement of the second member 80 in the axial direction is restricted. Contrary to this, an upward movement of the second member 80 in the axial direction along the tubular holding portion 71 is permitted in a state where the tubular holding portion 71 is at the second rotational position. That is, the rib 74 and the large-diameter portion 812 are positioned with respect to each other and the fourth pattern forming area 73R4 of the first detectable portion 73 prepared to receive the second detectable portion 83 and the second detectable portion 83 are positioned with respect to each other.

FIGS. 11 and 12 show a state where the second member 80 is in the indicating posture T2. In the indicating posture T2, the engaging portion 81 is located at the uppermost position of the third area Y3 of the tubular holding portion 71. The second indicator 82 reaches the first area Y1 to be located before the first indicator 72, thereby concealing the first indicator 72. Thus, in the indicating posture T2, the indication area 821 of the second indicator 82 is located in the first to fourth window portions 111 to 141 (FIG. 2) and the printing of "OTHER" appears.

Further, the second detectable portion 83 reaches the second area Y2 of the tubular holding portion 71 to form the detection pattern for the switch device 90. That is, the second detectable portion 83 is located in the fourth pattern forming area 73R4 to form a convex surface at the convexo-concave forming unit P3. The bottommost contact switch 93 of the switch device 90 is pressed down by coming into contact with the second detectable portion 83. In this way, a signal indicating the detection pattern "××○" of the individual area R4 shown in the above Table 1 is output to the switch device 90.

In the indicating posture T2, the second member 80 is supported by the supporting claw 713 of the elastic supporting portion 711 provided on the circumferential surface of the tubular holding portion 71 (FIG. 12). When the engaging portion 81 is moved upward by the operation of the user, the inner peripheral wall of the small-diameter portion 814 interferes with the supporting claw 713 and elastically deforms the supporting piece 712 inwardly. When the engaging portion 81 moves up to the uppermost position of the third area Y3 of the tubular holding portion 71, the supporting claw 713 is released from the pressing by the inner peripheral wall of the small-diameter portion 814 and the supporting piece 712 is elastically restored. In this way, the supporting claw 713 supports a lower edge part of the engaging portion 81 and the second member 80 is maintained in the indicating posture T2.

This enables the second member 80 to be easily held at an upper position and released therefrom by the elastic supporting portion 711.

When the second member 80 is pulled up, the rib 74 and the large-diameter portion 812 (or large-diameter portion 813) of the engaging portion 81 are engaged, wherefore an upward movement of the engaging portion 81 is guided by the rib 74. Accordingly, when the user pulls up the second member 80, the rotation of the second member 80 about the axis of the tubular holding portion 71 can be prevented. Further, after the second member 80 is set in the indicating posture T2, the rotation of the tubular holding portion 71 about the axis is hindered by the engagement of the rib 74 and the large-diameter portion 812. In this way, the rib 74 restricts the rotation of the tubular holding portion 71 about the axis in a state where the second indicator 82 is located in the first area Y1 and the second detectable portion 83 is located in the second area Y2. Thus, even if the user tries to rotate the tubular holding portion 71 by operating the dial operating portion 75 in the indicating posture T2, this can be prevented, wherefore the occurrence of an erroneous operation can be prevented. That is, a change in setting caused by an erroneous operation from one sheet size to another sheet size can be forcibly suppressed.

In the case of returning the second member 80 from the indicating posture T2 to the retracted posture T1, the user may press down the operation surface 832 on the top surface of the second detectable portion 83 (interference piece 831) to retract the supporting claw 713 inwardly and release the supported state. This causes the second member 80 to move downward along the tubular holding portion 71. Since the rib 74 and the large-diameter portion 812 are disengaged after the second member 80 reaches the retracted posture T1, the tubular holding portion 71 is free to rotate about the axis and the user can indicate the size by the first indicator 72 and set the size by the first detectable portion 73 for sheets of the standard size.

According to the sheet size setting device S of this embodiment described above, the tubular holding portion 71 is rotated via the dial operating portion 75, whereby it is easily possible to indicate the sheet size and automatically detect the sheet size by the switch device 90. Further, the sheet size setting device S is formed by a combination of the first member 70 for indicating the standard sizes of sheets and forming the detection patterns and the second member 80 for indicating the unique size "Other" and forming the detection pattern, and the second member 80 is movable in the axial direction to indicate the size and form the detection pattern only when the tubular holding portion 71 is located at the second rotational position. Since such an operation step is required, an erroneous operation is unlikely in setting the sheet size between the standard sheet sizes and the "Other" sheet size. Thus, it is possible to provide the sheet size setting device S which can easily set the sheet size and, on the other hand, can maximally suppress erroneous setting of the sheet size.

Particularly, the first member 70 is so arranged that the tubular holding portion 71 extends in the vertical direction and the second member 80 is located below the first member 70 in the state where a movement in the axial direction is restricted by the rib 74 and moves upward due to a movement of the engaging portion 81 along the tubular holding portion 71 in the state where the movement in the axial direction is permitted. Since being formed to be moved in the vertical direction in this way, the second member 80 can be smoothly retracted (state where the movement in the axial direction is restricted) and moved to an indicating position.

Although one embodiment of the present disclosure has been described in detail above, the present disclosure is not limited to the above embodiment and may be, for example, embodied as follows.

(1) The example in which the first and second detectable portions 73, 83 have the convexo-concave shapes and the switch device 90 turned on and off by the convexo-concave shapes is used as the sheet size detector has been illustrated in the above embodiment. Instead of this, an optical sensor may be, for example, used as the sheet size detector and the first and second detectable portions 73, 83 may form detection patterns which are combinations of reflecting surfaces and light absorbing surfaces.

(2) The example in which the rib 74 projects as a restricting member on the circumferential surface of the tubular holding portion 71 and is fitted into the large-diameter portion 812 has been illustrated in the above embodiment. Instead of this, the restricting member may be formed such that a groove extending in the axial direction is formed in the circumferential surface of the tubular holding portion 71, an elongated projection is provided on the inner circumferential surface of the through hole 811 of the engaging portion 81, and the second member 80 is made movable when these groove and elongated projection are positioned with respect to each other.

(3) The example in which the second member 80 indicates the "Other" sheet size and forms the detection pattern has been illustrated in the above embodiment. This is one example. For example, the second member 80 may indicate one or more standard sheet sizes and form detection patterns therefor.

As described above, according to the present disclosure, it is possible to provide a sheet size setting device capable of maximally suppressing erroneous setting of sheet sizes while easily setting the sheet sizes, and a sheet feeder or an image forming apparatus to which this sheet size setting device is applied.

Although the present discloser has been fully described by way of example with reference to the accompanying drawings, it is to be understood that various changes and modifications will be apparent to those skilled in the art. Therefore, unless otherwise such changes and modifications depart from the scope of the present discloser hereinafter defined, they should be construed as being included therein.

What is claimed is:

1. A sheet size setting device for indicating the size of sheets stored in a sheet cassette and giving identification information of the size to a predetermined sheet size detector, comprising:

a first member which includes a tubular holding portion having a first area and a second area in an axial direction and rotatable about an axis, a first indicator held in the first area of the tubular holding portion and adapted to display a first size of the sheets, and a first detectable portion formed in the second area of the tubular holding portion and to be detected for the identification of the first size by the sheet size detector; and a second member which is a member to be assembled with the first member movably in the axial direction of the tubular holding portion and includes an engaging portion to be engaged with the tubular holding portion, a second indicator connected to the engaging portion and adapted to indicate a second size of the sheets, and a second detectable portion to be detected for the identification of the second size by the sheet size detector; wherein:

the first member includes a restricting portion capable of restricting a movement of the second member in the axial direction; and the restricting portion restricts the movement of the second member in the axial direction when the tubular holding portion is located at a first rotational position and permits the movement of the second member in the axial direction, thereby causing the second indicator to reach the first area and the second detectable portion to reach the second area, when the tubular holding portion is located at a second rotational position different from the first rotational position.

2. A sheet size setting device according to claim 1, wherein:

the restricting portion is a rib extending in the axial direction of the tubular holding portion of the first member; and the engaging portion of the second member includes a first part which interferes with an end edge of the rib when the tubular holding portion is located at the first rotational position and a second part which can be guided along the rib when the tubular holding portion is located at the second rotational position.

3. A sheet size setting device according to claim 1, wherein:

the restricting portion restricts the rotation of the tubular holding portion about the axis in a state where the second indicator of the second member is located in the first area and the second detectable portion is located in the second area.

4. A sheet size setting device according to claim 1, wherein:

the sheet size detector includes a plurality of contact switches which project and retract due to interference with detection targets;

the first detectable portion includes convexo-concave forming portions for forming detectable patterns for sheet size identification by the plurality of contact switches and a receiving portion where a detection pattern is not formed, and the second detectable portion is an interference piece insertable into the receiving portion and the interference piece forms the detection pattern when reaching the second area.

5. A sheet size setting device according to claim 4, wherein:

the first member is so arranged that the tubular holding portion extends in a vertical direction, and the second member is located below the first member in a state where the movement thereof in the axial direction is restricted by the restricting portion, and movable upward because of a movement of the engaging portion along the tubular holding portion in a state where the movement thereof in the axial direction is permitted.

6. A sheet size setting device according to claim 5, wherein:

the tubular holding portion includes an elastic supporting portion which supports the engaging portion in an elevated state of the second member.

7. A sheet feeder, comprising:

a sheet cassette for storing sheets;

the sheet size setting device according to claim 1; and a sheet size detector for detecting the size of the sheets stored in the sheet cassette by detecting the first detectable portion or the second detectable portion.

8. An image forming apparatus, comprising:

the sheet feeder according to claim 7; and an image forming unit for forming an image on a sheet supplied from the sheet cassette.

* * * * *